United States Patent [19]

Gross et al.

[11] 4,073,072

[45] Feb. 14, 1978

[54] AIR CIRCULATION SHOE MATERIAL

[75] Inventors: Alexander Louis Gross, Aspen, Colo.; Erik O. Giese, Key Biscayne, Fla.

[73] Assignee: Comfort Products, Inc., Aspen, Colo.

[21] Appl. No.: 719,080

[22] Filed: Aug. 31, 1976

Related U.S. Application Data

[63] Continuation-in-part of Ser. No. 605,999, Aug. 20, 1975, abandoned.

[51] Int. Cl.[2] ..... A43B 13/38

[52] U.S. Cl. ..... 36/44

[58] Field of Search ..... 36/44, 3 A, 3 B; 428/88, 175; 28/72 FT

[56] References Cited

U.S. PATENT DOCUMENTS

| | | | |
|---|---|---|---|
| Re. 24,007 | 5/1955 | Foster | 28/72 FT X |
| 578,794 | 3/1897 | Warner | 36/3 B |
| 1,213,941 | 1/1917 | Patrick | 36/3 A |
| 1,219,890 | 3/1917 | West | 36/44 |
| 2,425,388 | 8/1947 | Oestricher | 36/44 X |
| 2,627,644 | 2/1953 | Foster | 428/175 |
| 2,713,193 | 7/1955 | Robbins et al. | 428/175 X |
| 3,009,232 | 11/1961 | Martin | 28/72 FT |
| 3,015,149 | 1/1962 | Foster et al. | 428/88 |
| 3,264,761 | 8/1966 | Johnson | 36/3 A |

*Primary Examiner*—Alfred R. Guest
*Attorney, Agent, or Firm*—Pennie & Edmonds

[57] ABSTRACT

A flexible air circulation shoe material adapted to be used as an insole for a shoe and also adapted to form the upper of a shoe. The material comprises two mesh-like fabrics separated by a corrugated separating material extending between and joining the two fabrics to provide a non-collapsible air space therebetween and where the separating material resists deformation of the fabrics towards each other upon application of a compressive force.

9 Claims, 4 Drawing Figures

FIG. 1
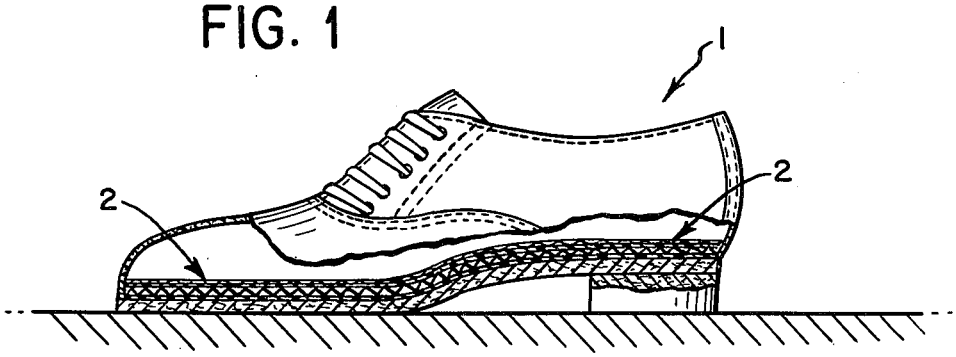
FIG. 2
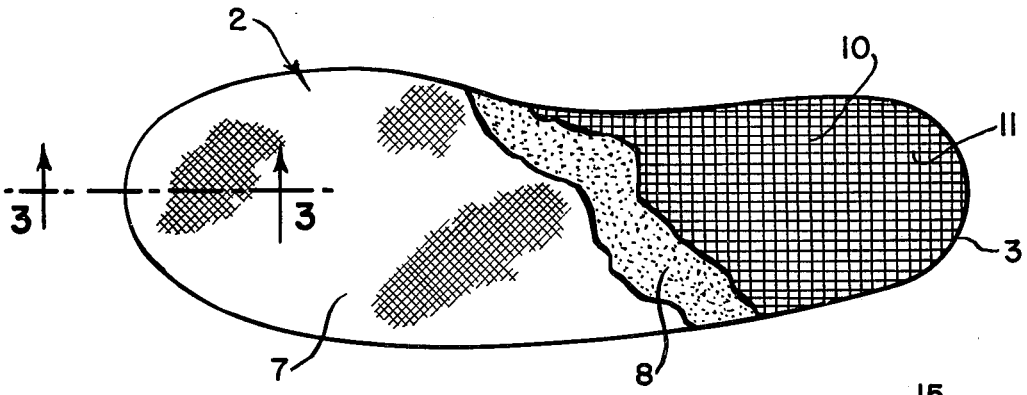
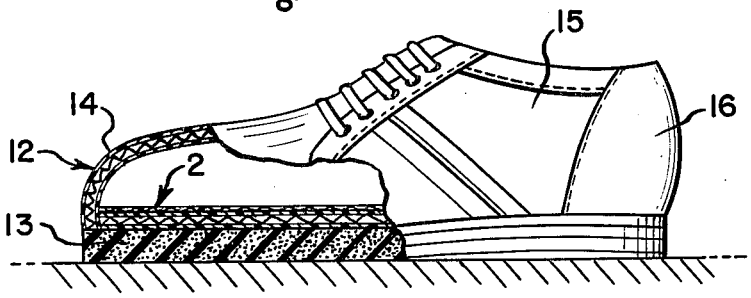
FIG. 4
FIG. 3
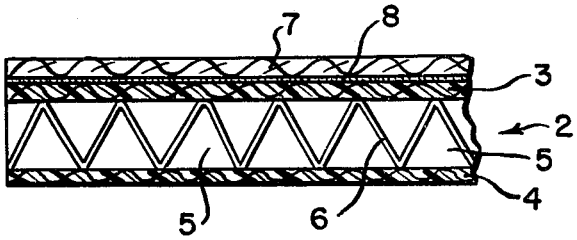

AIR CIRCULATION SHOE MATERIAL

REFERENCE TO OTHER APPLICATIONS

This application is a continuation-in-part of our copending application Ser. No. 605,999 filed Aug. 20, 1975, now abandoned.

BACKGROUND OF THE INVENTION

A problem that has arisen with the advent of artificial turf when used as playing surfaces in outdoor sports areas is that the artificial surface becomes extremely hot. This problem also exists with some forms of tennis courts, for example outdoor hard surface courts, where the playing surface is often of a dark heat-absorbent color. The heat from such surfaces is quickly transmitted through the sole of a conventional athletic shoe to the foot of the wearer to his discomfort.

Cushioning insoles comprising a composite fabric made up of two woven fabrics separated by a corrugated fabric have been proposed for use in shoes to provide thermal insulation. See for example the composite fabric described in U.S. Pat. No. RE 24,007. The composite fabrics as disclosed in that patent are described as being compressed to 30% under a loading of 2 psi. Where a composite fabric is used as an insole, the loading, assuming a wearer of between 90 and 180 pounds, will vary between 16 and 32 psi at the ball area of the foot and be even higher at the heel area. These high loadings will cause movement of the two woven fabrics of the prior art composite fabric towards each other flattening out the corrugated separating fabric. Any air channels that might exist in such fabric due to the corrugated separating fabric are substantially reduced or even completely eliminated so that any thermal insulation due to the air in the corrugated channels or cooling due to circulation of air through the corrugated channels is materially reduced. It is therefore an object of our invention to provide for shoe material which may be included as an insole in shoe constructions when originally manufactured, or sold and applied as a separate item to existing shoe constructions and which will provide a cooling non-collapsible air circulation space between the bottom of the foot of the wearer and the sole of the shoe under high load conditions as occurs at the ball and heel areas of a sole of a foot.

A further problem existing with some forms of athletic shoes, as for example track or marathon shoes, is that the friction between the shoe body and the foot of the wearer adds to the heat in the shoe and that the body of the shoe tends to retain perspiration all adding to the discomfort of the wearer. It is therefore a further object of our invention to provide for a shoe material that may be utilized as the uppers for shoes and at the same time provide for a high degree of air circulation surrounding the foot of the wearer to aid in cooling and to aid in the evaporation of perspiration.

GENERAL DESCRIPTION OF THE INVENTION

Broadly, our invention includes having a shoe material which comprises two mesh-like fabrics woven from a solid monofilament plastic material which are separated by a corrugated separating material, prefereably a plastic monofilament. The two mesh-like fabrics are joined to the separating material such that the separating material forms a structure which resists deformation of the first and second mesh-like plastic fabrics towards each other upon application of a compressive force such as would occur when a wearer stands in a shoe into which the material is placed. The spacing between the two mesh-like fabrics forms a non-collapsible air space through which air may circulate and the openings in the fabrics formed by the mesh-like construction form additional areas through which air may circulate even under high load conditions existing at the ball and heel areas of the sole of a foot. A cloth fabric, prefereably a nylon tricot, may be applied to one of the mesh-like layers between the shoe and the sole of the foot of the wearer and where the material is used as an insole in order to improve the degree of slipperiness between the sole of the foot and the heel. Fabric or other covering material may be applied to the outer surface of the material for appearance purposes when the material is used as uppers.

DESCRIPTION OF THE DRAWINGS

FIG. 1 is a partial sectional side view of a shoe having an air circulation insole made from material constructed according to the invention;

FIG. 2 is a broken plan view of an insole of the type adapted to fit in the shoe of FIG. 1;

FIG. 3 is an enlarged section of a portion of the insole of FIG. 2 taken along lines 3—3 of FIG. 2; and FIG. 4 is a partial sectional side view of a shoe having an upper portion made from material constructed according to the invention.

DETAILED DESCRIPTION OF THE PREFERRED EMBODIMENTS

Referring to FIG. 1 there is illustrated a shoe 1 having an insole 2 therein constructed according to the invention. The shoe may comprise any shoe type including a tennis or athletic shoe or even a boot construction, the insole constructed according to the invention adapted to be included in all types.

Referring to FIG. 2 the insole construction 2 as shown is shaped into the general configuration of the sole of a shoe.

Referring to FIG. 3 the insole construction comprises a first mesh-like plastic fabric 3 spaced from a second mesh-like plastic fabric 4 to form an air space 5 therebetween. Both fabrics 3 and 4 are woven from solid monofilament plastic yarn constructions. A corrugated plastic monofilament 6 extends between and joins both the fabrics 3 and 4. The corrugated monofilament 6 is of such strength to prevent excessive deformation of fabrics 3 and 4 towards each other upon application of a compressive force such as would occur when a wearer exerts his weight on the insole. This construction assures that the air space 5 is non-collapsible. The plastic material comprising the corrugated monofilament as well as the monofilament yarns making up the two mesh-like fabrics 3 and 4 may comprise saran, polyethylene or polypropylene.

A cloth liner 7 may be applied to the fabric 3 by means of a layer of adhesive 8 to provide a slip surface between the insole and the bottom of the foot of the wearer. The liner preferably comprises a tricot made from a nylon material.

Referring to FIG. 2 the mesh-like fabric 3, as well as the fabric 4 not shown in that Figure, comprises a woven material having spaced warp extending yarns 10 and spaced weft extending yarns 11. The spacing between adjacent yarns forms openings through which air may circulate thus further contributing to the circulation features of the insole construction.

The insole construction may be shaped for applying to the shoe at the time the shoe is made, or because of its convenient construction, may be packaged and sold separately such that it may be installed in a conventional shoe. The overall thickness of the insole is on the order of 0.120 inches - 0.140 inches such that it may be applied to a conventional shoe without alteration to the shoe.

The uppers of a shoe, particularly a track or marathon type shoe, may be made from material constructed according to the invention as shown in FIG. 4. The shoe there illustrated has an upper portion 12 extending above the sole 13 comprising the usual toe portion 14, side portion 15 and heel portion 16. The upper portion comprises the same plastic mesh-like fabrics 3 and 4 separated by the corrugated monofilament 6 as in the insole 2 so as to provide the air circulation spaces 5. In this manner, the sides and top of the foot of the wearer may be cooled by circulated air. The plastic mesh-like material may be covered by a porous cloth or thin leather lining to provide additional strength to the shoe and to present a pleasing appearance. As shown the shoe is provided with the insole construction 2 of the shoe of FIG. 1.

The corrugated monofilament 6 and yarns 10 and 11 making up the shoe material should be of a size and have a tensile and compressive strength sufficient so that there will be less than a 10% reduction of thickness of the shoe material on application of a load of 30 psi. This is important so that the ball area 20 and heel area 21 of the insole as shown in FIG. 2 which correspond to the ball and heel areas of the foot will not be compressed due to the weight of the wearer and so cause collapse of the air space 5. We have found that a shoe material constructed with the following yarn diameters and material will meet this condition. Warp extending yarns 10 comprise a shrinkable polyethylene solid monofilament material having a diameter of 8.75 mils spaced 44 yarns to the inch. Weft extending yarns 11 comprise a polypropylene solid monofilament material having a diameter of 10.0 mils spaced 125 yarns to the inch. The corrugated monofilament 6 comprises a saran solid monofilament material having a diameter of 11.0 mils and having 8 to 9 corrugations per inch with the yarns being spaced 22 yarns to the inch. A shoe material constructed according to the invention will distribute the loads applied to the ball and heel areas of the insole by the weight of the wearer to insure non-collapse of the air space 5.

It has been found that an insole constructed of a shoe material as described above contributes to the comfort of the wearer under extremely hot conditions as may exist with hard surface tennis courts or playing fields having artificial surfaces as well as under extremely cold conditions as may exist outdoors in the winter. This is becuse the non-collapsible air spaces of the shoe material act as spacers separating the bottom of the foot from the sole of the shoe contacting the ground surface thus reducing flow of heat from the shoe sole to the foot under hot conditions and flow of heat from the foot to the shoe sole under cold conditions. Further the non-collapsible air space provides under hot conditions a space into which perspiration droplets from the foot of the wearer or from a sock surrounding the foot may fall to in effect provide a "wicking" action which assists in removing moisture from the surface of the foot and also from the sock. This helps cool the foot while at the same time maintain the sock dryer than if the moisture was not removed thus preserving the insulation characteristics of the sock. This "wicking" action also under extreme cold conditions helps maintain the dryness of the sock and thus its insulation properties.

We claim:

1. An air circulation shoe material comprising a mesh-like plastic first fabric, a mesh-like plastic second fabric spaced from said first fabric, a corrugated plastic separating material extending between and joining said first and second fabrics to form a non-collapsible air space between said fabrics and where said separating material is adapted to resist deformation of said first and second fabrics towards each other to maintain the integrity of the non-collapsible air spaces upon application of a compressive force equal to the body weight of the wearer.

2. An air circulation shoe material according to claim 1 wherein said material is in the shape of a sole of a shoe.

3. An air circulation shoe material according to claim 2 wherein one of said fabrics has a layer of a slip fabric affixed thereto.

4. An air circulation shoe material according to claim 3 wherein said slip fabric comprises a tricot.

5. An air circulation shoe material according to claim 1 wherein said first and second fabrics each comprise a woven fabric having yarns extending in warp and weft directions and with the yarns extending in parallel directions being spaced from each other to form an air opening between adjacent yarns.

6. An air circulation shoe material according to claim 1 wherein said separating material comprises a monofilament.

7. An air circulation shoe material according to claim 1 wherein said material conforms in shape to the upper of a shoe.

8. An air circulation shoe material according to claim 1 wherein the thickness of the material will be reduced no more than 10% upon application of a load of 30 psi.

9. An air circulation shoe material comprising a woven mesh-like first plastic fabric having weft and warp extending yarns, a woven mesh-like second plastic fabric having weft and warp extending yarns spaced from said first plastic fabric, the weft extending yarns of both said fabrics comprising a solid monofilament material of 10 mils diameter spaced 44 yarns to the inch and the warp extending yarns of both said fabrics comprising a solid monofilament material of 8.75 mils diameter spaced 125 yarns to the inch, and a plurality of corrugated solid plastic monofilament yarns of 11.0 mils diameter spaced 22 yarns to the inch joining and separating said first and second fabrics whereby the thickness of the shoe material will not be reduced in excess of 10% upon application of a load of 30 psi.

* * * * *